US007200957B2

(12) United States Patent
Hubbard et al.

(10) Patent No.: US 7,200,957 B2
(45) Date of Patent: Apr. 10, 2007

(54) FOOTWEAR AND OTHER FOOT-RECEIVING DEVICES INCLUDING A WRAPPED CLOSURE SYSTEM

(75) Inventors: Hanmi Hubbard, Portland, OR (US); Christopher J. Lyke, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 117 days.

(21) Appl. No.: 11/053,581

(22) Filed: Feb. 9, 2005

(65) Prior Publication Data

US 2006/0185194 A1 Aug. 24, 2006

(51) Int. Cl.
*A43C 11/00* (2006.01)

(52) U.S. Cl. ..... 36/50.1

(58) Field of Classification Search ..... 36/50.1, 36/58.5, 58.6, 91

See application file for complete search history.

(56) References Cited

U.S. PATENT DOCUMENTS 2,126,094 A * 8/1938 Daniels ..... 36/11.5
4,654,985 A 4/1987 Chalmers
4,724,626 A 2/1988 Baggio
4,741,115 A 5/1988 Pozzobon
4,754,560 A 7/1988 Nerrinck
5,659,982 A * 8/1997 Muraoka et al. ..... 36/131
5,819,439 A * 10/1998 Sanchez ..... 36/89
6,568,104 B2 5/2003 Liu
6,637,130 B2 * 10/2003 Urie et al. ..... 36/11.5
2003/0066207 A1 * 4/2003 Gaither ..... 36/50.1

* cited by examiner

*Primary Examiner*—Ted Kavanaugh
(74) *Attorney, Agent, or Firm*—Banner & Witcoff, Ltd.

(57) ABSTRACT

Foot-receiving devices, such as articles of footwear, include a foot-covering member and a foot-supporting member defining a foot-receiving chamber. One or more strap members may be provided for securing the device to a user's foot. At least one strap member may wrap at least one time around the top of the foot-receiving chamber and at least one time around the bottom of the foot-receiving chamber. Methods for providing such foot-receiving devices also are described.

42 Claims, 5 Drawing Sheets

FOOTWEAR AND OTHER FOOT-RECEIVING DEVICES INCLUDING A WRAPPED CLOSURE SYSTEM

FIELD OF THE INVENTION

Aspects of the present invention relate generally to systems and methods for securing a foot in a foot-receiving device, such as an article of footwear. In at least some examples, at least a portion of the closure systems according to the invention may wrap around the foot-receiving chamber of the foot-receiving device. Such systems and methods, in at least some examples, advantageously may be used in footwear or other foot-receiving devices for children.

BACKGROUND

Conventional footwear typically attaches to a wearer's foot via shoelaces. While effective, shoelaces can be difficult for some to use. For example, some people can have difficulty tying shoelaces, e.g., because of a lack of finger dexterity, arthritis, or other conditions, or the like. Children can have particular difficulty in securely tying shoelaces.

Other problems can exist with the use of conventional shoelaces. For example, the laces can inadvertently loosen in use, resulting in safety hazards for wearers, e.g., from tripping, unexpected shoe loss, etc. This is a particular hazard for athletic footwear used in competition, practice, and the like; in children's footwear; etc. Additionally, shoelaces can form tight knots if not properly loosened, making it difficult to untie the laces and remove the shoe. The presence of knots can be particularly frustrating for children and others who have difficulty manipulating laces.

Accordingly, it would be advantageous to provide an alternative closure or securing system for footwear or other foot-receiving device products that is easy and quick to use, even for children, and that can securely and comfortably hold a foot in the foot-receiving device.

SUMMARY

Aspects of the present invention relate to foot-receiving devices and systems and methods for securing a wearer's feet in such devices. Foot-receiving devices (including articles of footwear) in accordance with example aspects of this invention may include: (a) a foot-covering member (e.g., an upper member); (b) a foot-supporting member (e.g., a sole member) engaged (directly or indirectly) with the foot-covering member, wherein the foot-covering member and the foot-supporting member, at least in part, define a foot-receiving chamber; and (c) a securing system for at least partially securing the foot-receiving device to a user's foot. The securing system may include: (i) a strap member having a first portion fixedly engaged with the foot-covering member and/or the foot-supporting member at a toe or mid-foot area thereof, and (ii) a securing element for holding the strap member. The strap member may be located so as to extend at least one time along a portion of the foot-covering member and around a top portion of the foot-receiving chamber and at least one time along a portion of the foot-supporting member and around a bottom portion of the foot-receiving chamber.

Additional examples of foot-receiving devices in accordance with this invention may include: (a) a foot-covering member (such as an upper member); (b) a foot-supporting member (such as a sole member), wherein the foot-covering member and the foot-supporting member, at least in part, define a foot-receiving chamber; (c) a first strap member having a first portion engaged with the foot-covering member and/or the foot-supporting member, wherein the first strap member extends along a first portion of the foot-covering member; and (d) a second strap member having a first portion engaged with the foot-covering member and/or the foot-supporting member, wherein the second strap member extends at least one time along a second portion of the foot-covering member and around a top portion of the foot-receiving chamber and at least one time along a first portion of the foot-supporting member and around a bottom portion of the foot-receiving chamber. Optionally, if desired, a third strap member having a first portion engaged with the foot-covering member and/or the foot-supporting member may be included. At least some of the strap members may be used secure the foot-receiving device to a user's foot.

Additional aspects of this invention relate to methods for producing foot-receiving devices, such as articles of footwear, of the type described above. Such methods may include, for example: (a) providing a foot-receiving device including a foot-covering member and a foot-supporting member that define a foot-receiving chamber; (b) engaging a first portion of a strap member with the foot-covering member and/or the foot-supporting member at a toe or mid-foot area thereof; (c) wrapping the strap member around the foot-receiving device such that the strap member extends at least one time along a portion of the foot-covering member and around a top portion of the foot-receiving chamber and at least one time along a portion of the foot-supporting member and around a bottom portion of the foot-receiving chamber; and (d) providing a securing system for holding a foot in the foot-receiving chamber, wherein the securing system utilizes the strap member.

Other method aspects in accordance with examples of this invention may include, for example: (a) providing a foot-receiving device including a foot-covering member and a foot-supporting member that define a foot-receiving chamber; (b) engaging a first portion of a first strap member with the foot-covering member and/or the foot-supporting member; (c) engaging a first portion of a second strap member with the foot-covering member and/or the foot-supporting member; (d) extending the second strap member around the foot-receiving device such that the second strap member extends at least one time along a portion of the foot-covering member and around a top portion of the foot-receiving chamber and at least one time along a portion of the foot-supporting member and around a bottom portion of the foot-receiving chamber; and (e) engaging the first strap member with the second strap member. Optionally, if desired, a third strap member may be engaged with the foot-covering member and/or the foot-supporting member, wherein the third strap member extends along a third portion of the foot-covering member. All of these various strap members may be used, at least in part, to secure a user's foot in the foot-receiving chamber.

BRIEF DESCRIPTION OF THE DRAWINGS

The above and other objects, features, and advantages of the present invention will be more readily apparent and more fully understood from the following detailed description, taken in connection with the appended drawings, in which.

DETAILED DESCRIPTION

Figure 1:
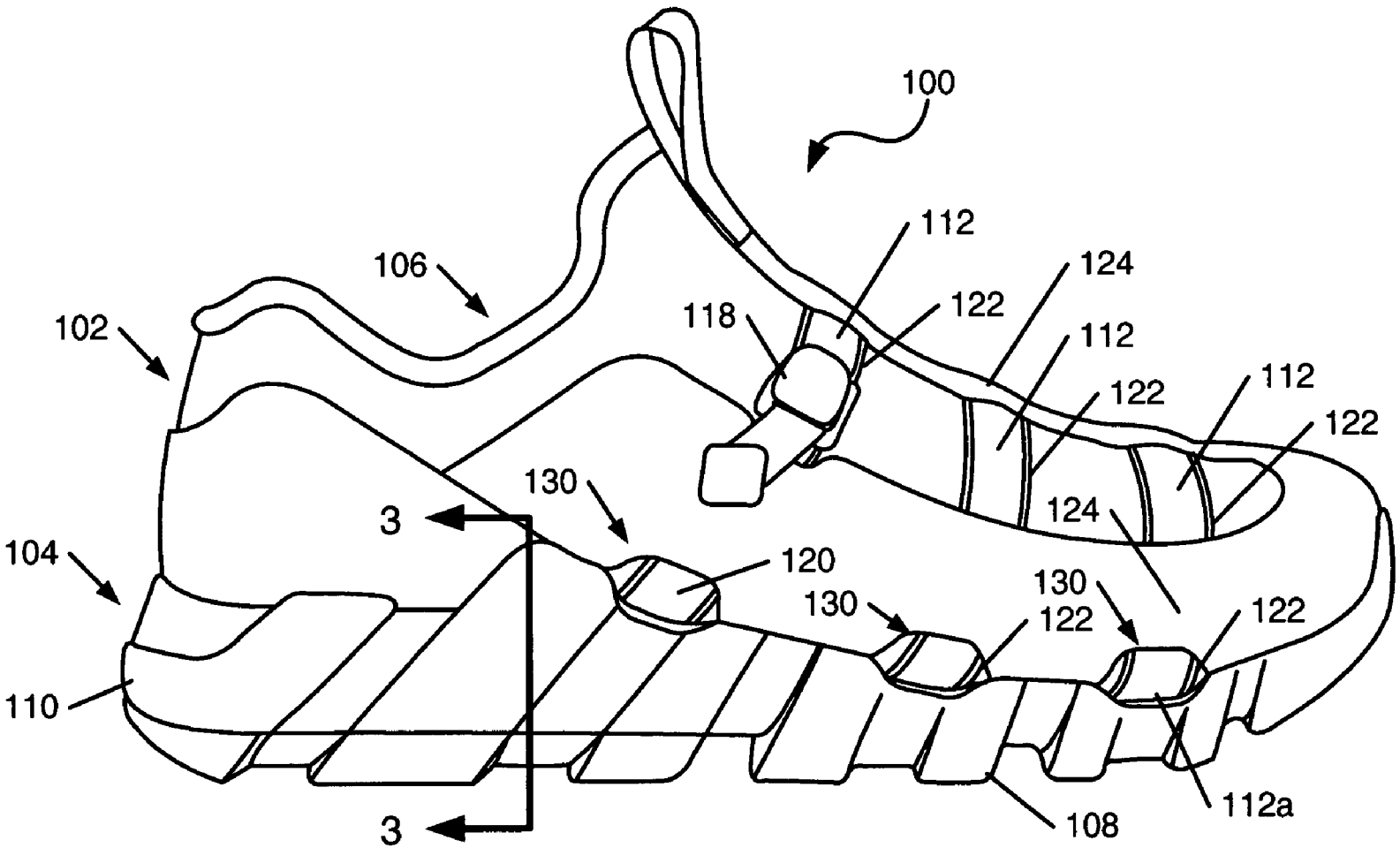
FIG. 1 illustrates a lateral side view of an example piece of footwear in accordance with this invention.

In the following description of various examples of the invention, reference is made to the accompanying drawings, which form a part hereof, and in which are shown by way of illustration various example structures, systems, and environments in which the invention may be practiced. It is to be understood that other specific arrangements of parts, example structures, systems, and environments may be utilized, and that structural and functional modifications may be made without departing from the scope of the present invention. Also, while the terms "top," "bottom," "side," "front," "rear," "above," "below," "under," "over," and the like may be used in this specification to describe various example features and elements of the invention, these terms are used herein as a matter of convenience, e.g., based on the example orientations shown in the figures and/or a typical orientation of a product in use. Nothing in this specification should be construed as requiring a specific three dimensional or relative orientation of structures in order to fall within the scope of this invention.

Various specific examples of the invention are described in detail below in conjunction with the attached drawings. To assist the reader, this specification is broken into various subsections, as follows: Terms; General Description of Articles of Footwear and Other Foot-Receiving Devices in Accordance with Examples of this Invention; Specific Examples of the Invention; and Conclusion.

A. Terms

The following terms are used in this specification, and unless otherwise noted or clear from the context, these terms have the meanings provided below.

"Foot-receiving device" means any device or product into which a wearer places at least some portion of his or her foot. In addition to all types of footwear (described below), "foot-receiving devices" include, but are not limited to: bindings and other devices for securing feet in snow skis, cross country skis, water skis, snowboards, and the like; bindings, clips, or other devices for securing feet in pedals for use with bicycles, exercise bikes, games, and the like; bindings, clips, or other devices for receiving feet during play of video games; and the like.

"Footwear" means any type of product worn on the feet, and this term includes, but is not limited to: all types of shoes, boots, sneakers, sandals, thongs, flip-flops, mules, scuffs, slippers, sport-specific shoes (such as golf shoes, ski boots, etc.), and the like. "Footwear" may protect the feet from the environment and/or enhance a wearer's performance (e.g., physically, physiologically, medically, etc.). As used herein, the longitudinal direction of an article of footwear may be considered as generally being comprised of three sections, namely a forefoot or toe area in the foremost third of the shoe, a midfoot or arch area in the middle third, and a rearfoot or heel area in the rearmost third.

"Foot-covering members" include one or more portions of a foot-receiving device that extend at least partially over and/or at least partially cover at least some portion of the wearer's foot, e.g., so as to assist in holding the foot-receiving device in place with respect to the wearer's foot. "Foot-covering members" include, but are not limited to, upper members of the type provided in some conventional footwear products.

"Foot-supporting members" include one or more portions of a foot-receiving device that extend at least partially beneath at least some portion of the wearer's foot, e.g., so as to assist in supporting the foot and/or attenuating the reaction forces to which the wearer's foot would be exposed, for example, when stepping down in the foot-receiving device. "Foot-supporting members" include, but are not limited to, sole members of the type provided in some conventional footwear products. Such sole members may include conventional outsole, midsole, and/or insole members.

"Ground-contacting elements" or "members" include at least some portions of a foot-receiving device structure that contact the ground in use, and/or at least some portions of a foot-receiving device structure that engage another element or structure in use. The term "ground," as used herein, means any surface that a foot or an article of footwear contacts in use, including but not limited to: grass, dirt, sand, snow, ice, tile, flooring, carpeting, and the like. Such "ground-contacting elements" may include, for example, but are not limited to, outsole elements provided in some conventional footwear products. "Ground-contacting elements" in at least some example structures may be made of suitable and conventional materials to provide long wear and protect the foot and/or to prevent the remainder of the foot-receiving device structure from wear effects, e.g., when contacting the ground or other surface in use.

B. General Description of Articles of Footwear and Other Foot-Receiving Devices in Accordance with Examples of this Invention In general, aspects of this invention relate to systems for securing feet in foot-receiving devices (e.g., closure systems for footwear and other foot-receiving devices). Foot-receiving devices according to at least some examples of this invention may include: (a) a foot-covering member; (b) a foot-supporting member engaged (directly or indirectly) with the foot-covering member, wherein the foot-covering member and the foot-supporting member, at least in part, define a foot-receiving chamber; and (c) a securing system for at least partially securing the foot-receiving device to a user's foot. The securing system may take on various forms in examples of this invention. For example, the securing system may include: (i) a strap member having a first portion fixedly engaged with at least one of the foot-covering member or the foot-supporting member in a toe or mid-foot portion thereof, and (ii) a securing element for holding the strap member in place with respect to at least one of the foot-covering member or the foot-supporting member (the securing element may be located and/or engaged with the foot-covering member or the foot-supporting member at the mid-foot and/or heel area of the foot-receiving device structure). The strap member may be located so as to extend at least one time along a portion of the foot-covering member and around a top portion of the foot-receiving chamber and at least one time along a portion of the foot-supporting member and around a bottom portion of the foot-receiving chamber. If desired, the strap member may be fixedly engaged with the foot-covering member and/or the foot-supporting member through a selectively releasable connection, e.g., to enable replacement of the strap, if necessary or desired.

The securing element for holding or otherwise engaging the strap member may take on various forms or constructions without departing from the invention. For example, the securing element may include: a hook-and-loop fastener arrangement, a buckle arrangement, a clasp arrangement, a magnetic fastener arrangement, and/or any other suitable or desired mechanical connector or fastener arrangement, including conventional connector or fastener arrangements that are known and used in the art. If desired, at least some portion of the securing element may include a mechanical member that engages the strap member (such as a buckle, a portion of a hook-and-loop fastener arrangement, a clasp, a direction change element, or the like), wherein the mechanical member is fixedly connected to at least one of the foot-covering member or the foot-supporting member (e.g., at the heel or mid-foot portion of the foot-receiving device, optionally via a strap member connected to the foot-covering member or the foot-supporting member).

If desired, in at least some example foot-receiving device structures in accordance with this invention, at least some portions of the foot-covering member may include one or more "track elements" extending along its surface (e.g., its exterior surface), wherein at least some portions of the strap member lie on and/or extend along the track element(s). The "track elements" may be made from a material having a low coefficient of friction to movement (e.g., sliding) with respect to the strap member, to enable easy tightening and loosening of the strap member (e.g., during foot insertion and removal activities) while also reducing or preventing damage or wear to the strap member and/or the foot-covering member. If desired, the track element(s) may be covered or partially covered (e.g., by a material panel, by passing through a passageway defined in the foot-covering member, or the like), and the strap member may pass between the track element and the material panel and/or through the passageway.

As described above, the strap member also may extend around the bottom portion of the foot-receiving chamber. In at least some example structures, a groove may be defined in the foot-supporting member and/or the foot-covering member, wherein the strap member extends through the groove. The interior of the groove may be lined with a material (such as a rigid thermoplastic material, e.g., made by injection or compression molding) that may help maintain a stable groove or tunnel structure, help prevent wear of the midsole material, help prevent wear of the strap, and/or help maintain a low coefficient of friction between the strap and other elements of the foot-receiving device structure. This groove lining material, in at least some examples, may extend around the side edges of the foot-supporting member toward the foot-covering member. In additional example structures, a cover element may be provided (e.g., engaged with at least one of the foot-covering member or the foot-supporting member) for covering the groove, e.g., to allow user access to the groove for changing strap members, if necessary or desired, etc.

Some example structures and devices in accordance with this invention relate to articles of footwear, such as athletic footwear, that include closure systems and/or securing systems like those described above. Such pieces of footwear may include: (a) an upper member; (b) a sole member engaged (directly or indirectly) with the upper member, wherein the upper member and the sole member, at least in part, define a foot-receiving chamber; and (c) a securing system for securing the article of footwear to a wearer's foot. Such securing systems may include, for example: (i) a strap member having a first portion fixedly engaged with at least one of the upper member or the sole member at a toe or mid-foot portion thereof, and (ii) a securing element for holding the strap member (in some examples, the securing element may be located and/or engaged with the upper member or the sole member at the mid-foot and/or heel area of the structure). This strap member may extend at least one time along a portion of the upper member and around a top portion of the foot-receiving chamber and at least one time along a portion of the sole member and around a bottom portion of the foot-receiving chamber. Footwear articles of this type further may include additional strap members, securing elements, grooves, track elements, material panels, passageways, cover members, and/or the like, e.g., like those described above.

Additional example aspects of this invention may include foot-receiving devices (such as articles of footwear) that include: (a) a foot-covering member (such as an upper member); (b) a foot-supporting member (such as a sole member) engaged (directly or indirectly) with the foot-covering member, wherein the foot-covering member and the foot-supporting member, at least in part, define a foot-receiving chamber; (c) a first strap member having a first portion engaged with at least one of the foot-covering member or the foot-supporting member, wherein the first strap member extends along a first portion of the foot-covering member; and (d) a second strap member having a first portion engaged with at least one of the foot-covering member or the foot-supporting member, wherein the second strap member extends at least one time along a second portion of the foot-covering member and around a top portion of the foot-receiving chamber and at least one time along a first portion of the foot-supporting member and around a bottom portion of the foot-receiving chamber. The first strap member and the second strap member, at least in part, are engaged to secure the foot-receiving device (e.g., an article of footwear) to a wearer's foot. Of course, articles of footwear or other foot-receiving devices of this type also may include additional strap members, securing elements, grooves, track elements, material panels, passageways, cover members, and/or the like, e.g., like those described above.

In at least some example structures according to the invention, foot-receiving devices of the type described above may include a third strap member having a first portion engaged with at least one of the foot-covering member or the foot-supporting member, wherein the first strap member extends along a third portion of the foot-covering member (the third strap member may be located and/or engaged, in at least some examples, at the mid-foot or heel area of the foot-receiving device). As examples, this third strap member may include a mechanical clasp or clamp element or other connector element that engages the second strap member. Optionally, the first strap member may include a direction change member, and the second strap member may engage this direction change member, change direction, and then extend to engage the mechanical clasp or clamp element or other connector element of the third strap member. If desired, in at least some examples of this invention, the first strap member and the third strap member may constitute opposite ends of a single strap member, e.g., a strap member that extends along the foot-supporting member and/or beneath the bottom portion of the foot-receiving chamber (optionally through a groove provided in the foot-covering member and/or the foot-supporting member) so that the free ends of the strap member are loose and available on opposite sides of the foot-covering member. Any or all of the first, second, or third strap elements may extend through passageways, beneath material flaps, along track elements, through grooves, or the like without departing from the invention.

Additional aspects of this invention relate to methods for using foot-receiving devices, such as articles of footwear, of the types described above. Such methods may include, for example: (a) providing a foot-receiving device including a foot-covering member and a foot-supporting member engaged (directly or indirectly) with the foot-covering member so as to, at least in part, define a foot-receiving chamber; (b) engaging a first portion of a strap member with at least one of the foot-covering member or the foot-supporting member; (c) wrapping the strap member around the foot-receiving device such that the strap member extends at least one time along a portion of the foot-covering member and around a top portion of the foot-receiving chamber and at least one time along a portion of the foot-supporting member and around a bottom portion of the foot-receiving chamber; and (d) providing a securing system for at least partially holding a foot in the foot-receiving chamber, wherein the securing system utilizes the strap member.

Other method aspects in accordance with some examples of this invention may include: (a) providing a foot-receiving device including a foot-covering member and a foot-supporting member engaged (directly or indirectly) with the foot-covering member so as to, at least in part, define a foot-receiving chamber; (b) engaging a first portion of a first strap member with at least one of the foot-covering member or the foot-supporting member; (c) engaging a first portion of a second strap member with at least one of the foot-covering member or the foot-supporting member; (d) extending the second strap member around the foot-receiving device such that the second strap member extends at least one time along a portion of the foot-covering member and around a top portion of the foot-receiving chamber and at least one time along a portion of the foot-supporting member and around a bottom portion of the foot-receiving chamber; and (e) engaging the first strap member with the second strap member. Optionally, if desired, a first portion of a third strap member may be engaged with at least one of the foot-covering member or the foot-supporting member, wherein the third strap member extends along a third portion of the foot-covering member. This third strap member, along with the various other strap members, may be used, at least in part, to secure a wearer's foot in the foot-receiving chamber.

Method aspects in accordance with examples of this invention further may include one or more of the following steps: (a) placing a foot in the foot-receiving chamber; (b) securing the foot in the foot-receiving chamber using the securing system and/or strap arrangements; (c) disengaging one or more of the strap members from the foot-covering member and/or the foot-supporting member; and/or (d) engaging a new strap member with at least one of the foot-covering member or the foot-supporting member in place of a previously disengaged strap member.

Specific examples of the invention are described in more detail below. The reader should understand that these specific examples are set forth merely to illustrate examples of the invention, and they should not be construed as limiting the invention.

C. Specific Examples of the Invention

The various figures in this application illustrate examples of closure and/or securing systems useful in systems and methods according to examples of this invention. When the same reference number appears in more than one drawing, that reference number is used consistently in this specification and the drawings to refer to the same part throughout.

Figure 2:
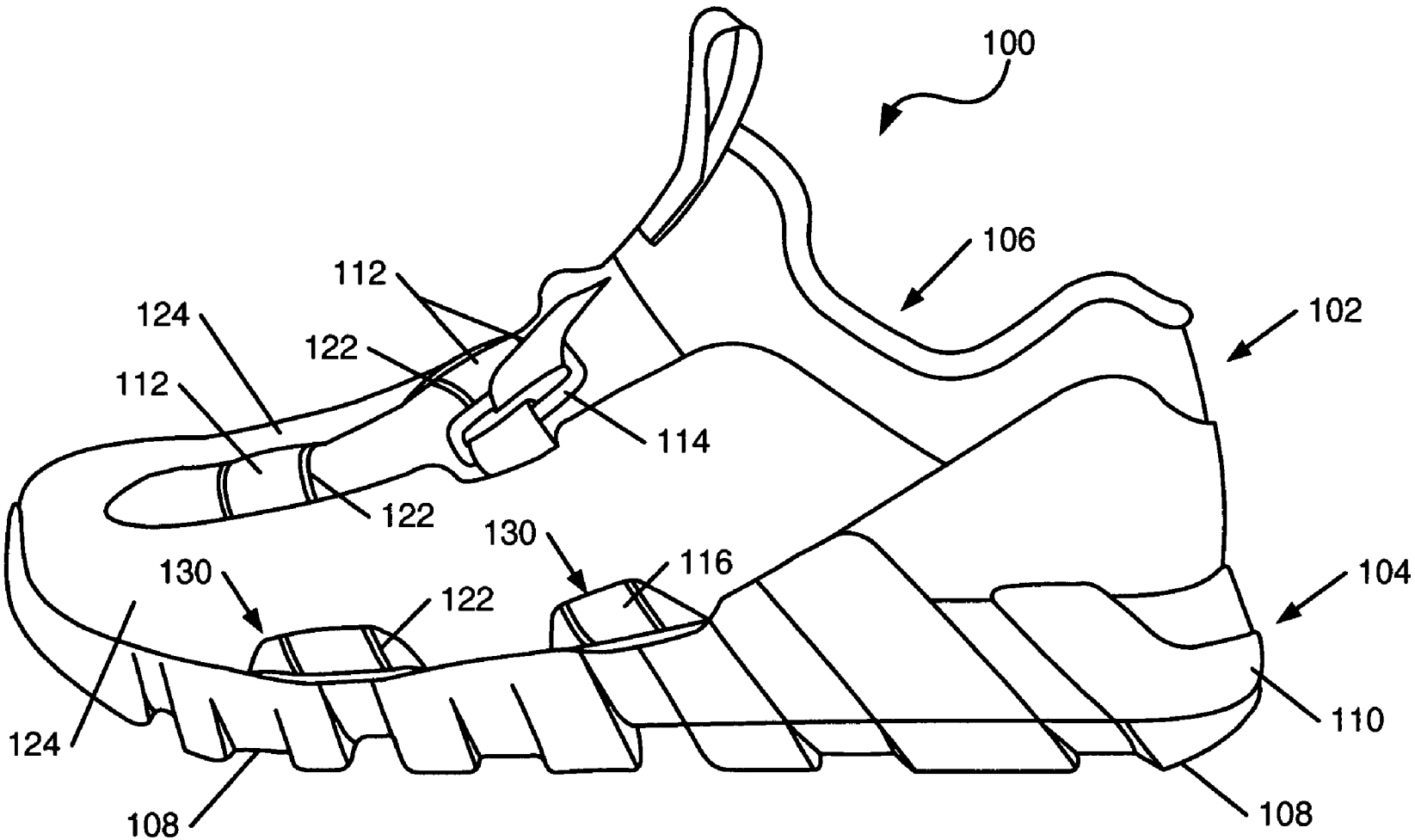
FIG. 2 illustrates a medial side view of an example piece of footwear in accordance with this invention.

FIGS. 1 and 2 illustrate an example foot-receiving device structure 100 in the form of an article of footwear (e.g., a child's shoe, an athletic shoe, etc.) in accordance with example aspects of this invention. The view shown in FIG. 1 is a lateral side view of the shoe structure 100, and the view shown in FIG. 2 is a medial side view. The illustrated shoe structure 100 includes an upper member 102 and a sole structure 104. The upper member 102 includes an opening 106 for receiving a wearer's foot. The upper member 102 may be made from leather, rubber, elastic materials, polymeric materials, canvas or other cloth materials, plastics, synthetic rubbers or leathers, and/or other desired materials, including materials known and conventionally used in the art.

The sole structure 104 may include several elements. For example, the sole structure 104 may include an outsole member 108 (or other ground-contacting element). This outsole member 108 (or other ground-contacting element) may be made of suitable and conventional materials to provide traction and long wear, and it may be used to protect the foot and/or prevent the remainder of the foot-receiving device structure from wear effects, e.g., when contacting the ground or other surface in use of the footwear product. The sole structure 104 further may include a midsole member 110 that provides impact-attenuating characteristics, e.g., to assist in attenuating the reaction forces to which the wearer's foot would be exposed, for example, when stepping down in the shoe in contact with the ground or other surface. The sole structure 104 further may include an insole member (not shown in the figures), e.g., provided within or adjacent the upper member 102, that provides a comfortable interface for engaging (directly or indirectly) the wearer's foot. The upper member 102 and the sole structure 104, at least in part, may define a foot-receiving chamber of the article of footwear, and this chamber may be accessed by the wearer's foot via opening 106.

Figure 3:
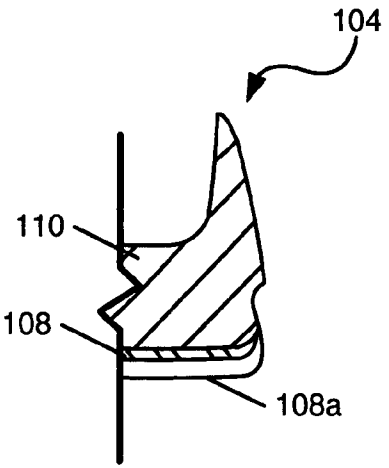
FIG. 3 is a partial cross-sectional view taken along line 3—3 in FIG. 1.

FIG. 3 provides a partial cross sectional view of an example sole structure 104 taken along line 3—3 in FIG. 1, i.e., at the heel or mid-foot area of the shoe 100. As shown, the midsole 110 is relatively thick in this region as compared to the outsole 108. If desired, the midsole 110 may extend over and completely cover (or substantially completely cover) the interior length of the outsole member 108. Alternatively, in some examples, the midsole 110 may cover just a portion of the outsole member 108 (e.g., in the heel and/or mid-foot areas). Reference number 108*a* in FIG. 3 represents the very bottom of a tread element of the outsole member 108, provided and designed to directly contact the ground or other surface in use of the shoe product. The midsole 110 may be made from ethylvinylacetate ("EVA"), polyurethane ("PU"), or other suitable materials, such as polymeric foam materials or other conventional materials known or used in the art. The outsole member 108 may be made from rubber, duralon, or other suitable materials, including conventional materials known or used in the art.

The shoe structure 100 as shown in FIGS. 1 and 2 further includes a securing system for at least partially securing the shoe structure 100 to a wearer's foot. In this illustrated example, the securing system includes a first strap member 112 that is fixedly (and optionally releasably) engaged with at least one of the upper member 102 or the sole structure 104, e.g., at a toe or mid-foot area of the shoe structure 100. In the example illustrated in FIGS. 1 and 2, a first end portion 112*a* of the strap member 112 is engaged with the shoe structure 100 between the midsole 110 and the outsole 108 of the shoe 100. This first end portion 112*a* of the strap member 112 may be engaged with at least one of the upper member 102 or the sole structure 104 in any desired manner without departing from the invention, including via sewing, via mechanical connectors (e.g., snaps, hook-and-loop fasteners, etc.), via a pinching action (e.g., between the midsole 110 and/or the upper member 102 or the outsole 108, optionally using cam or other clamp type structure), via adhesives or cements, etc. Also, if desired, the first end 112*a* of the strap member 112 may be fixed with at least one of the upper member 102 or the sole structure 104 in a releasable or removable manner, e.g., via a snap engagement, a hook-and-loop fastener arrangement, other mechanical connectors, etc., e.g., to allow replacement of one strap member 112 with a new one, if the original becomes worn, broken, etc.

Figure 4:
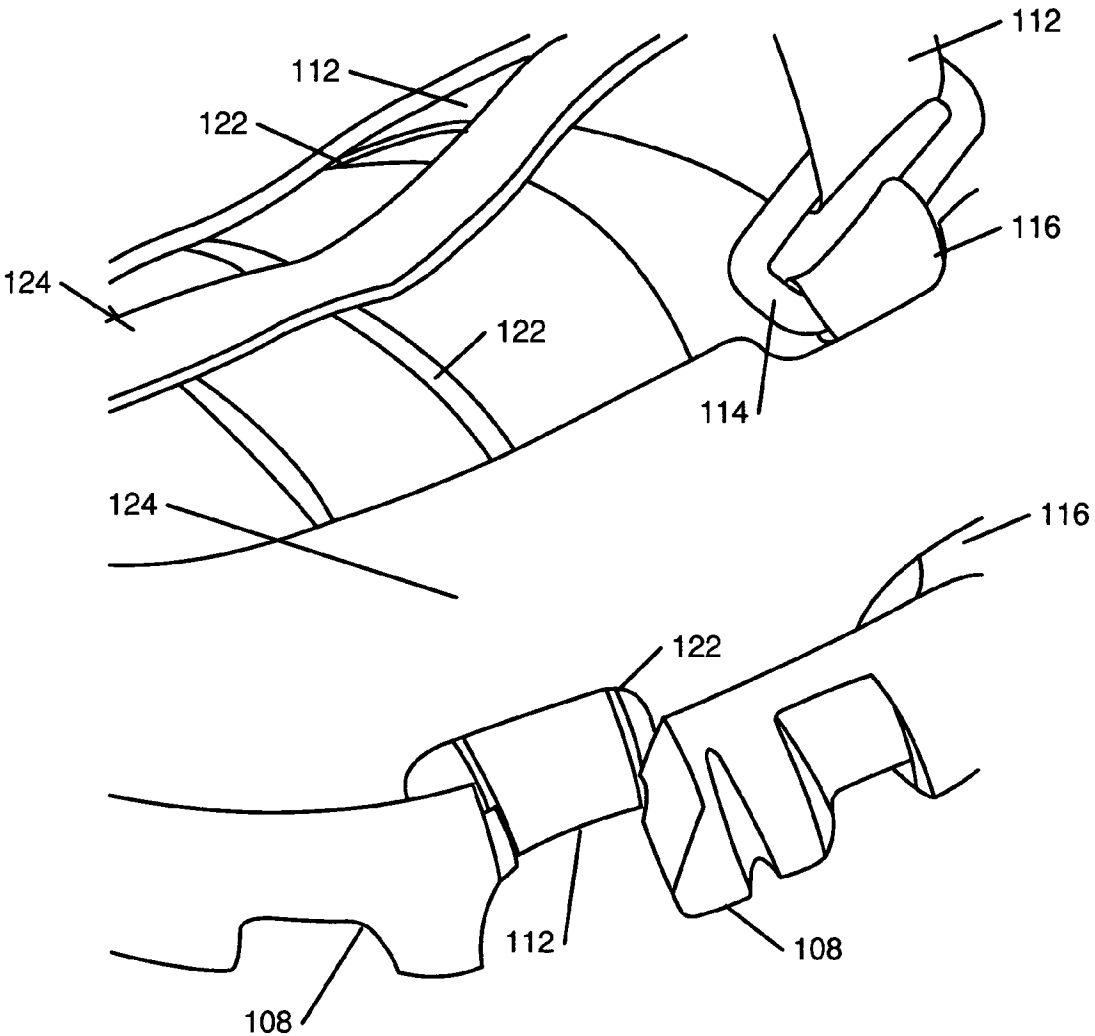
FIG. 4 illustrates an enlarged and partial cutaway view of a portion of an example piece of footwear at a location where a securing strap element extends around the bottom of the foot-receiving chamber.
Figure 6:
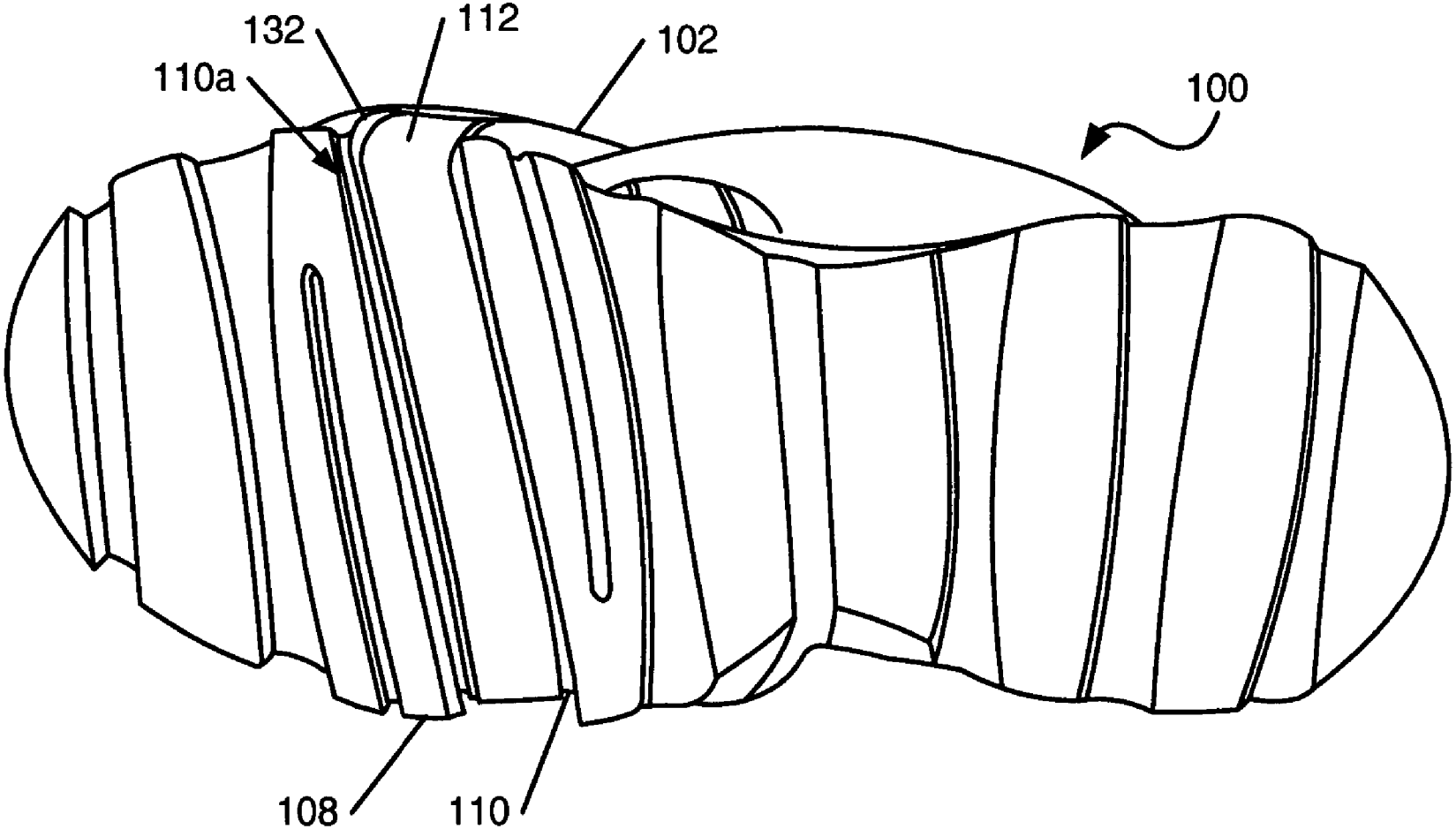
FIG. 6 illustrates the underside of an example piece of footwear in accordance with this invention with the cover member removed.

As described above, the first end 112*a* of strap member 112 may engage with the upper member 102 and/or the sole member 104 at the toe or mid-foot area of the shoe (on the lateral side of the shoe 100, in the illustrated example). From there, the strap member 112 extends along a portion of the upper member 102 and around the top portion of the foot-receiving chamber of the shoe structure 100. Once on the other side of the upper member 102 (i.e., to the medial side of the shoe structure 100, as shown in FIGS. 2, 4, and 6), the strap member 112 extends along a portion of the sole structure 104 (e.g., between the midsole 110 and the upper member 102, between the midsole 110 and the outsole member 108, etc.), around the bottom portion of the foot-receiving chamber of the shoe structure 100, and back to the other side (i.e., the lateral side, in this example structure 100). From there, the strap member 112, in this example structure 100, extends along another portion of the upper member 102 and around the top portion of the foot-receiving chamber of the shoe structure 100 to a mechanical strap direction change element 114. As shown in FIGS. 2 and 4, the strap member 112 engages direction change element 114 to enable the strap member 112 to turn and extend in another direction along the upper member 102 and along the top of the foot-receiving chamber.

The direction change element 114 may be provided at any desired position and/or in any desired manner, or not at all, without departing from the invention. For example, the direction change element 114 may be provided and/or mounted in the mid-foot or heel area of shoe structure 100, optionally fixedly mounted directly to the upper member 102 and/or a portion of the sole structure 104. As another example, as illustrated in FIGS. 2 and 4, the direction change element 114 may be mounted on a strap element 116 that extends from (and is engaged at) a location between the midsole 110 and the upper member 102 and/or between the midsole 110 and the outsole member 108 of the shoe structure 100. The strap element 116 may be fixedly engaged with some portion of the shoe structure 100 in any desired manner, including in the various manners described above in connection with the engagement of the first end 112*a* of strap member 112 with the remainder of the shoe structure 100. Also, if desired, the strap element 116 and/or the direction change element 114 may be releasably or removably mounted to the remainder of the shoe structure 100 without departing from the invention.

The direction change element 114 may take on any desired structure without departing from the invention. For example, the direction change element 114 may simply constitute a bar or other mechanical member (e.g., an open rectangular member, as shown in FIGS. 2 and 4) behind which the strap member 112 engages and turns to change directions. If desired, in some examples, at least a portion of the bar or mechanical member of the direction change element 114 that contacts the strap member 112 may rotate (e.g., like a roller), to allow easier movement of the strap member 112 around the direction change element 114.

The direction change member 114 and/or its optional associated strap element 116 may form at least a portion of a strap securing system for this shoe structure 100. The securing system of this example shoe structure 100 further may include a strap securing element 118 that engages and holds the strap member 112. Any desired type of securing element 118 may be used without departing from this invention, including conventional securing elements 118 known in the art, such as buckles, clasps, clamps, cams, hook-and-loop fasteners, or other mechanical devices. In the illustrated example, securing element 118 is clamp or a cam type device in which the strap 112 freely moves through an opening provided when the clamp or cam is in the open position, but the strap 112 is pinched between two portions of the clamp or cam member when the device is closed, thereby holding the strap 112 in place with respect to the securing element 118.

Like the direction change element 114, the securing element 118 may be provided at any desired position and/or in any desired manner without departing from the invention. For example, the securing element 118 may be provided and/or mounted in the mid-foot or heel area of shoe structure 100, optionally fixedly mounted directly to the upper member 102 and/or a portion of the sole structure 104. As another example, as illustrated in FIG. 1, the securing element 118 may be mounted on a strap element 120 that extends from (and is engaged at) a location between the midsole 110 and the upper member 102 and/or between the midsole 110 and the outsole member 108 of the shoe structure 100. The strap element 120 may be engaged with some portion of the shoe structure 100 in any desired manner, including in the various manners described above in connection with the engagement of the first end 112*a* of strap member 112 with the remainder of the shoe structure 100. Also, if desired, the strap element 120 and/or the securing element 118 may be releasably or removably mounted to the remainder of the shoe structure 100 without departing from this invention.

If desired, in accordance with at least some examples of this invention, the strap element 116 for the direction change member 114 and the strap element 120 for the securing element 118 may constitute opposite ends of a single strap member (that extends around the bottom of the foot-receiving chamber (e.g., along a portion of the sole structure)). Alternatively, if desired, the strap elements 116 and 120 may constitute independent and separate elements that are independently and separately engaged with some portion of the shoe structure 100 (e.g., engaged with the upper member 102, the midsole 110, and/or the outsole 108).

Through the use of strap member 112, which wraps around a wearer's foot and engages a securing system (e.g., including a direction change member 114 (optionally mounted on a strap element 116) and a securing element 118 (optionally mounted on a strap element 120) in the illustrated example structure), the shoe structure 100 may be quickly, easily, and securely mounted to a wearer's foot. Moreover, the strap element 112 and securing system may be easily engagable with one another (e.g., using a simple hook-and-loop, clamp, clasp, or cam system) so as to be operable by a child or others that have difficulty tying shoes or operating small mechanical connectors. Optionally, if desired (and if adequate room is available along the length of the shoe 100), the strap member 112 may be wrapped around the wearer's foot multiple times (e.g., two or more times).

FIGS. 1, 2, and 4 further illustrate that, in this example structure 100, the strap member 112 extends along at least some portions of the upper member 102 in or on track elements 122. Track elements 122 may take on any desired form or be provided in any desired manner without departing from the invention. In at least some examples, the track elements 122 will include one or more additional pieces of material that are sewn, glued, and/or otherwise adhered to or engaged with the material making up the upper member 102.

As another example, the track elements 122 may be recessed into the upper member 102 as grooves cut into the upper member 102 surface. The track elements 122 may be made of or covered with a material having a low coefficient of friction with respect to (and when directly engaged with) the strap member 112 so that the strap member 112 will be able to more easily move along the track (e.g., during strap tightening or loosening activities, when the foot moves in the shoe, etc.) without excessively wearing or damaging the strap member 112. In other words, if the material or construction of the upper member 102 would cause excessive or rapid wear of the strap member 112 (and/or vice versa), track elements 122 may be provided, at least at some areas along the upper member 102, to help reduce and/or eliminate wear of the strap member 112 and/or the upper member 102. Alternatively or optionally, if desired, the track elements 122 may be provided for purely decorative purposes and/or for other functions without departing from the invention. As noted above, the track elements 122 need not completely cover all areas of the upper member 102 where the strap member 112 is present, although track elements 122 may be provided at all of these locations, if desired. Track elements 122 also may be provided for strap members 116 and 120, if desired, without departing from this invention.

FIGS. 1, 2, and 4 illustrate still additional features that may be present in at least some example products in accordance with this invention. For example, as shown in these figures, one or more pieces, panels, or flaps of material 124 may be included as part of the upper member 102 structure, wherein one or more of the various strap members 112, 116, and/or 120 run underneath and/or are retained by the piece(s) of material 124. The piece(s) of material 124 may be used to help hold the various strap members 112, 116, and/or 120 in place to help prevent a tripping or slipping hazard, particularly in the event that the securing mechanism (e.g., clasp 118) inadvertently or prematurely loosens or fails. In effect, the piece(s) of material 124 create one or more passageways or tunnels through which one or more of the various strap members 112, 116, and 120 extend. The piece(s) of material 124 also may help prevent the various strap members 112, 116, and/or 120 from falling away from the remainder of the shoe structure 100 when the shoe is not being used, thereby keeping the strap members 112, 116, and/or 120 available and relatively in place with next time the wearer puts on the shoe (making it easier to locate the straps 112, 116, and/or 120, orient them, and secure the shoe to the foot). The piece(s) of material 124 may be made of any desired material, including the same or similar material to that making up the upper member 102, the strap member(s), the track elements 122, etc.

Alternatively or additionally, if desired, rather than providing passageways using separate or independent piece(s) of material 124, the various strap members 112, 116, and/or 120 may be held in place by passageways or tunnels defined directly in the upper member structure 102. Such tunnels or passageways may be defined, for example, by cutting pairs of slits at least partially through the material of the upper member structure 102 to thereby form passageways, wherein a strap member enters the passageway through one slit of the pair and exits through the other slit of the pair.

As shown in FIGS. 1 and 2, at various locations 130 near the junction of the midsole member 110 and the upper member 108, the various strap members 112, 116, and/or 120 appear and are exposed to the external environment. Because these locations 130 are at the side of the foot, the straps 112, 116, and/or 120 could catch other objects as the wearer moves, thereby potentially causing a tripping hazard and/or inadvertently loosening the straps 112, 116, and/or 120. Accordingly, if desired, at least some of these locations 130 may be covered with a material, such as a plastic material, to prevent direct contact of the strap members 112, 116, and/or 120 with other objects. This cover material may be held on the remainder of the shoe structure 100 in any desired manner, such as via stitching with the material 124, held between midsole 110 and upper member 102, etc. By covering the entire open area of locations 130 with a cover material, inadvertent catching of the strap members 112, 116, and/or 120 can be avoided.

As shown in FIG. 6 and described above, after the strap member 112 extends along the upper member 102 from its attachment point near its first end 112*a*, it extends along a portion of the sole member 108 and beneath the foot-receiving chamber of the shoe structure 100. As shown in FIG. 6, a groove 110*a* may be defined in at least one portion of the sole structure 104 (such as in a portion of the midsole 110, in a portion of the outsole 108, in each, etc.), and the strap member 112 may extend along this groove 110. In this manner, the strap member 112 will not directly contact the ground or other surface when the shoe 100 is in use, thereby preventing excessive wear of the strap member 112. FIG. 6 shows a bottom view of an example shoe structure 100 with a portion of the outsole member 108 cut away, to better illustrate the location of the groove 110*a* and the position of the strap member 112.

Figure 5:
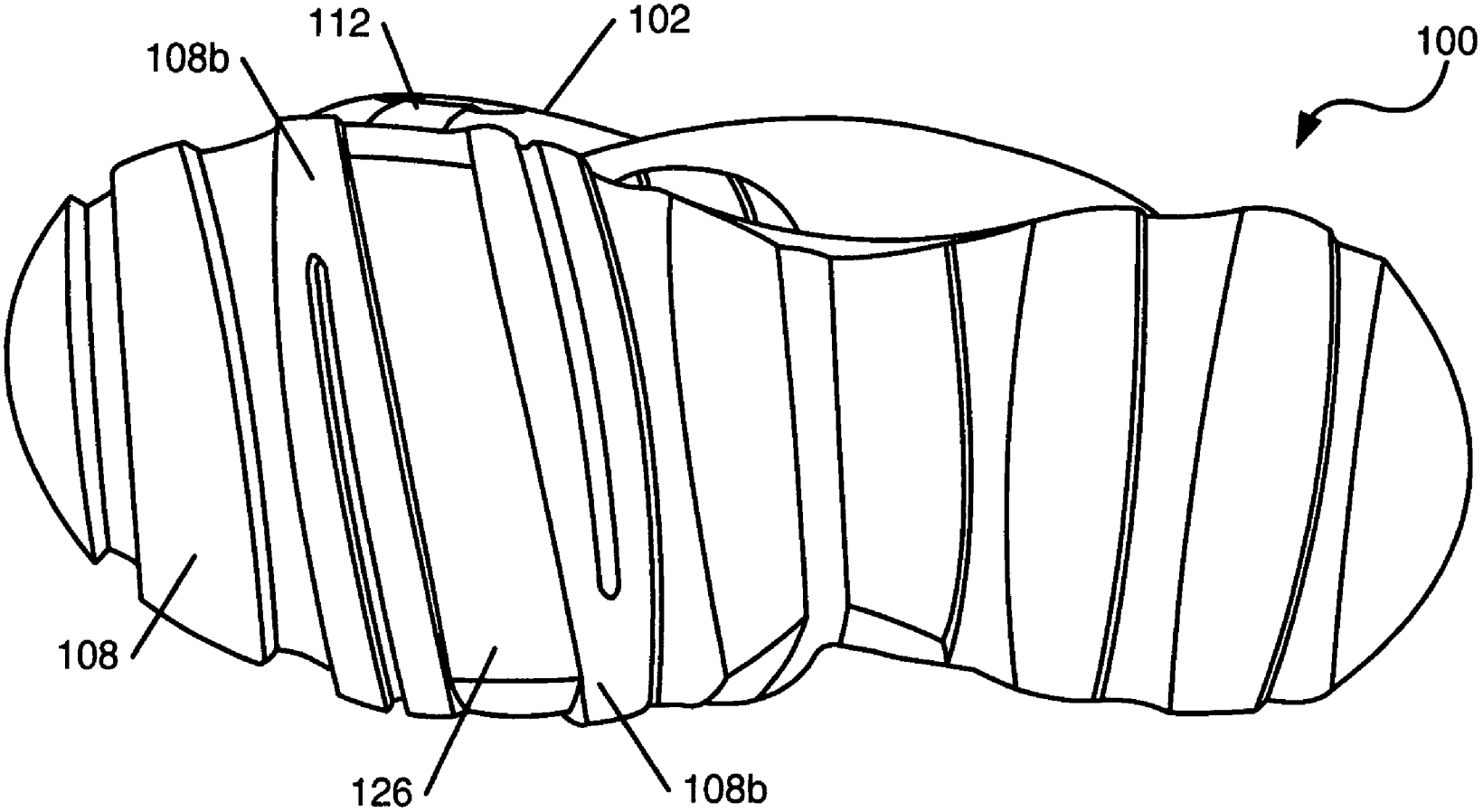
FIG. 5 illustrates the underside of an example piece of footwear in accordance with this invention with a cover member in place.

If desired, in at least some examples of the invention, the strap member 112 and the groove 110*a* may be located between the midsole member 110 and the outsole member 108. Alternatively, if desired, the groove 110*a* may have an exteriorly exposed open face (see FIGS. 4 and 6), and all or some portion of the groove 110*a* may be covered by a cover element 126 that engages with at least one of the upper member 102, the sole member 104, or some other portion of the shoe structure 100 (see FIG. 5). For example, the cover element 126 may be fixed to the remainder of the shoe structure 100 (e.g., the upper member 102 and/or the sole structure 104) via clips, clasps, hinges, detents, or other mechanical connectors; via adhesives or cements; etc. Optionally, if desired, the cover element 126 may be releasably or removably engaged with the remainder of the shoe structure 100 (e.g., with the upper member 102 and/or the sole structure 104) so as to allow access to the groove 110*a* and/or the strap element 112 (e.g., to change strap members, etc.). In still other examples, if desired, no cover member 126 is utilized and the groove 110*a* and strap element 112 may remain exposed.

The cover element 126 may be made from any suitable or desired material without departing from the invention. In some examples, the cover element 126 will be constructed from the same material making up at least some portions of the outsole member 108 and will appear similar to the remainder of the outsole member 108. In other examples, if desired, the cover element 126 may be made from plastic or other durable, wear resistant materials, and it may appear as a transparent or translucent window. Optionally, in at least some example structures in accordance with the invention, the cover element 126 may be located between adjacent raised tread elements 108*b* such that the cover element 126 is recessed somewhat and does not typically directly contact the ground when the shoe 100 is worn.

Also, if desired, the interior surface of the groove 110*a* may be covered or lined with a material 132 that helps maintain a stable groove or tunnel structure, helps prevent wear of the strap 112 and/or midsole 110, and/or helps maintain a low coefficient of friction between the strap 112 and the groove 110*a* or other portions of the shoe structure 100. For example, as illustrated in FIG. 6, the interior most surfaces or structures of the groove 110*a* (e.g., the surface(s) that the strap 112 contacts) may be covered or lined with a rigid material 132 that helps maintain a stable groove structure 110*a* in the relatively soft midsole foam material 110. The material 132 also may help prevent excessive wear of the relatively soft midsole foam material 110 by movement of the strap 112 and/or help prevent wear of the strap 112 due to friction with other surfaces. As shown in FIG. 6, this groove lining material 132 may extend around and partially along the side of the sole structure 104, reaching up toward the upper member 102. Any type of material may be used as the groove lining material without departing from the invention, including relatively rigid plastic materials, such as thermoplastic materials like thermoplastic polyurethanes ("TPUs"), thermosetting materials, or the like (e.g., produced and formed to an appropriate size and/or shape by injection or compression molding or in any other suitable or desired manner). Also, the groove lining material 132 may be placed or fixed in the groove 110*a* in any desired manner without departing from this invention, such as via adhesives, cements, mechanical connectors, fusing techniques, or the like.

Of course, footwear products and other foot-receiving devices in accordance with examples of this invention may be produced by securing an upper member (or other foot-covering member) to a sole member (or other foot-supporting member) in any suitable or desired manner, including in conventional manners known and used in the art, such as using adhesives, cements, sewing, fusing methods, mechanical connectors, or the like. The various strap members 112, 116, and/or 120 and their associated elements also may be included in the footwear structures 100 in any desired manner, e.g., using adhesives, cements, sewing, fusing methods, mechanical connectors, and the like.

Finally, while the invention has been described in detail with references to an article of footwear, those skilled in the art will appreciate that advantageous aspects of the invention also may be applied to other foot-receiving device products.

D. Conclusion

Various examples of the present invention have been described above, and it will be understood by those of ordinary skill that the present invention includes within its scope all combinations and subcombinations of these examples. Additionally, those skilled in the art will recognize that the above examples simply exemplify the invention. Various changes and modifications may be made without departing from the spirit and scope of the invention, as defined in the appended claims.

The invention claimed is:

1. An article of footwear, comprising:

an upper member;

a sole member engaged with the upper member, wherein a groove having an exteriorly exposed open face is defined in the sole member, and wherein the upper member and the sole member, at least in part, define a foot-receiving chamber; and a securing system for at least partially securing the article of footwear to a user's foot, wherein the securing system includes: (a) a strap member having a first portion fixedly engaged with at least one of the upper member or the sole member at a toe or mid-foot area thereof, wherein the strap member extends along the groove, and (b) a securing element for holding the strap member, wherein the strap member extends at least one time along a portion of the upper member and around a top portion of the foot-receiving chamber and at least one time along a portion of the sole member and around a bottom portion of the foot-receiving chamber.

2. An article of footwear according to claim 1, wherein the securing element includes a mechanical member connected to at least one of the upper member or the sole member in the heel or mid-foot area thereof, wherein the mechanical member engages the strap member.

3. An article of footwear according to claim 1, further comprising:

a track element extending along a surface of the upper member, wherein the strap member extends along the track element.

4. An article of footwear according to claim 1, further comprising:

a material panel attached to the upper member, wherein the material panel at least partially defines a passageway through which the strap member extends.

5. An article of footwear according to claim 1, further comprising:

a cover element engaged with at least one of the upper member or the sole member for covering the groove.

6. An article of footwear according to claim 1, further comprising:

a lining material provided in the groove.

7. An article of footwear according to claim 1, further comprising:

a track element extending along a surface of the upper member, wherein the track element has a surface including a material that supports a sliding movement of the strap member with respect to the track element.

8. An article of footwear according to claim 1, further comprising:

a liner element provided in the groove and engaging the strap member.

9. An article of footwear according to claim 1, wherein the securing system further includes a direction change member engaged with at least one of the upper member or the sole member, wherein the strap member engages the direction change member to thereby change a direction in which the strap member extends.

10. An article of footwear according to claim 9, wherein the direction change member includes an extending strap that extends along a second portion of the upper member and is fixedly engaged with at least one of the upper member or the sole member.

11. A foot-receiving device, comprising:

a foot-covering member;

a foot-supporting member engaged with the foot-covering member, wherein a groove having an exteriorly exposed open face is defined in the foot-supporting member, and wherein the foot-covering member and the foot-supporting member, at least in part, define a foot-receiving chamber; and a securing system for at least partially securing the foot-receiving device to a user's foot, wherein the securing system includes: (a) a strap member having a first portion fixedly engaged with at least one of the foot-covering member or the foot-supporting member at a toe or mid-foot area thereof, wherein the strap member extends along the groove, and (b) a securing element for holding the strap member, wherein the strap member extends at least one time along a portion of the foot-covering member and around a top portion of the foot-receiving chamber and at least one time along a portion of the foot-supporting member and around a bottom portion of the foot-receiving chamber.

12. A foot-receiving device according to claim 11, further comprising:

a track element extending along a surface of the foot-covering member, wherein the strap member extends along the track element.

13. A foot-receiving device according to claim 11, further comprising:

a material panel attached to the foot-covering member, wherein the material panel at least partially defines a passageway through which the strap member extends.

14. A foot-receiving device according to claim 11, further comprising:

a lining material provided in the groove.

15. A foot-receiving device according to claim 11, further comprising:

a cover element engaged with at least one of the foot-covering member or the foot-supporting member for covering the groove.

16. A foot-receiving device according to claim 11, wherein the strap member extends along the foot-covering member and around the top portion of the foot-receiving chamber at two separate locations.

17. A foot-receiving device according to claim 11, wherein the securing system further includes a direction change member engaged with at least one of the foot-covering member or the foot-supporting member, wherein the strap member engages the direction change member to thereby change a direction in which the strap member extends.

18. A foot-receiving device according to claim 17, wherein the direction change member includes an extending strap that extends along a portion of the foot-covering member and is fixedly engaged with at least one of the foot-covering member or the foot-supporting member.

19. A foot-receiving device according to claim 11, further comprising:

a track element extending along a surface of the foot-covering member, wherein the track element has a surface including a material that supports a sliding movement of the strap member with respect to the track element.

20. A foot-receiving device according to claim 11, further comprising:

a liner element provided in the groove and engaging the strap member.

21. An article of footwear, comprising:

an upper member;

a sole member engaged with the upper member, wherein a groove having an exteriorly exposed open face is defined in the sole member, and wherein the upper member and the sole member, at least in part, define a foot-receiving chamber;

a first strap member having a first portion engaged with at least one of the upper member or the sole member, wherein the first strap member extends along a first portion of the upper member; and a second strap member having a first portion engaged with at least one of the upper member or the sole member, wherein the second strap member extends at least one time along a second portion of the upper member and around a top portion of the foot-receiving chamber and at least one time along a first portion of the sole member, along the groove, and around a bottom portion of the foot-receiving chamber, and wherein the first strap member and the second strap member, at least in part, are engaged to secure the article of footwear to a user's foot.

22. An article of footwear according to claim 21, further comprising:

a track element extending along a surface of the upper member, wherein the second strap member extends along the track element.

23. An article of footwear according to claim 21, further comprising:

a material panel attached to the upper member, wherein the material panel at least partially defines a passageway through which the second strap member extends.

24. An article of footwear according to claim 21, further comprising:

a cover element engaged with at least one of the upper member or the sole member for covering the groove.

25. An article of footwear according to claim 21, further comprising:

a lining material provided in the groove.

26. An article of footwear according to claim 21, further comprising:

a track element extending along a surface of the upper member, wherein the track element has a surface including a material that supports a sliding movement of the second strap member with respect to the track element.

27. An article of footwear according to claim 21, further comprising:

a liner element provided in the groove and engaging the second strap member.

28. An article of footwear according to claim 21, wherein the first strap member includes a direction change member, wherein the second strap member engages the direction change member to thereby change a direction in which the second strap member extends.

29. An article of footwear according to claim 21, further comprising:

a third strap member having a first portion engaged with at least one of the upper member or the sole member, wherein the third strap member extends along a third portion of the upper member.

30. An article of footwear according to claim 29, wherein the first strap member includes a direction change member, wherein the second strap member engages the direction change member to thereby change a direction in which the second strap member extends, wherein the third strap member includes a mechanical clasp or clamp element, and wherein the second strap member extends from the direction change member to the mechanical clasp or clamp element.

31. An article of footwear according to claim 29, wherein the first strap member and the third strap member constitute opposite ends of a single strap element that extends along a second portion of the sole member and around the bottom portion of the foot-receiving chamber.

32. A foot-receiving device, comprising:

a foot-covering member;

a foot-supporting member engaged with the foot-covering member, wherein a groove having an exteriorly exposed open face is defined in the foot-supporting member, and wherein the foot-covering member and the foot-supporting member, at least in part, define a foot-receiving chamber;

a first strap member having a first portion engaged with at least one of the foot-covering member or the foot-supporting member, wherein the first strap member extends along a first portion of the foot-covering member; and a second strap member having a first portion engaged with at least one of the foot-covering member or the foot-supporting member, wherein the second strap member extends at least one time along a second portion of the foot-covering member and around a top portion of the foot-receiving chamber and at least one time along a first portion of the foot-supporting member, along the groove, and around a bottom portion of the foot-receiving chamber, and wherein the first strap member and the second strap member, at least in part, are engaged to secure the article of footwear to a user's foot.

33. A foot-receiving device according to claim 32, further comprising:

a track element extending along a surface of the foot-covering member, wherein the second strap member extends along the track element.

34. A foot-receiving device according to claim 32, further comprising:

a material panel attached to the foot-covering member, wherein the material panel at least partially defines a passageway through which the second strap member extends.

35. A foot-receiving device according to claim 32, further comprising:

a cover element engaged with at least one of the foot-covering member or the foot-supporting member for covering the groove.

36. A foot-receiving device according to claim 32, further comprising:

a lining material included in the groove.

37. A foot-receiving device according to claim 32, wherein the first strap member includes a direction change member, wherein the second strap member engages the direction change member to thereby change a direction in which the second strap member extends.

38. A foot-receiving device according to claim 32, further comprising:

a third strap member having a first portion engaged with at least one of the foot-covering member or the foot-supporting member, wherein the third strap member extends along a third portion of the foot-covering member.

39. A foot-receiving device according to claim 38, wherein the first strap member includes a direction change member, wherein the second strap member engages the direction change member to thereby change a direction in which the second strap member extends, wherein the third strap member includes a mechanical clasp or clamp element, and wherein the second strap member extends from the direction change member to the mechanical clasp or clamp element.

40. A foot-receiving device according to claim 38, wherein the first strap member and the third strap member constitute opposite ends of a single strap element that extends along a second portion of the foot-supporting member and around the bottom portion of the foot-receiving chamber.

41. A foot-receiving device according to claim 32, further comprising:

a track element extending along a surface of the foot-covering member, wherein the track element has a surface including a material that supports a sliding movement of the second strap member with respect to the track element.

42. A foot-receiving device according to claim 32, further comprising:

a liner element provided in the groove and engaging the second strap member.

* * * * *